US006986803B1

(12) United States Patent
Richards

(10) Patent No.: US 6,986,803 B1
(45) Date of Patent: Jan. 17, 2006

(54) GAS SCRUBBING PROCESS AND APPARATUS

(76) Inventor: Clyde N. Richards, 4887 Mission Blvd., San Diego, CA (US) 92109

( * ) Notice: Subject to any disclaimer, the term of this patent is extended or adjusted under 35 U.S.C. 154(b) by 2 days.

(21) Appl. No.: 11/054,299

(22) Filed: Feb. 9, 2005

(51) Int. Cl.
*B03C 3/014* (2006.01)

(52) U.S. Cl. ..... 95/71; 95/79; 96/27; 96/53; 96/55; 96/77; 422/4; 422/120; 422/186.04

(58) Field of Classification Search ..... 96/27, 96/52, 53, 55, 75, 77; 95/64, 70, 71, 79; 422/4, 120, 186.04
See application file for complete search history.

(56) References Cited

U.S. PATENT DOCUMENTS

| | | | | | |
|---|---|---|---|---|---|
| 3,681,896 | A | * | 8/1972 | Velkoff | 96/27 |
| 3,729,898 | A | | 5/1973 | Richardson | |
| 3,958,959 | A | | 5/1976 | Cohen et al. | |
| 4,072,477 | A | * | 2/1978 | Hanson et al. | 95/71 |
| 4,095,962 | A | | 6/1978 | Richards | |
| 4,141,698 | A | * | 2/1979 | Kihlstedt et al. | 95/69 |
| 4,193,774 | A | | 3/1980 | Pilat | |
| 4,345,916 | A | | 8/1982 | Richards et al. | |
| 4,544,382 | A | * | 10/1985 | Taillet et al. | 96/27 |
| 5,147,423 | A | | 9/1992 | Richards | |
| 5,476,538 | A | | 12/1995 | Nishio et al. | |
| 5,595,587 | A | * | 1/1997 | Steed | 96/27 |
| 5,843,210 | A | | 12/1998 | Paranjpe et al. | |
| 5,914,454 | A | * | 6/1999 | Imbaro et al. | 95/64 |
| 5,941,465 | A | * | 8/1999 | Richards | 239/690.1 |
| 6,156,098 | A | | 12/2000 | Richards | |
| 6,471,753 | B1 | | 10/2002 | Ahn et al. | |
| 6,551,382 | B1 | | 4/2003 | Richards | |
| 6,607,579 | B2 | | 8/2003 | Willey et al. | |
| 6,607,586 | B2 | | 8/2003 | Willey et al. | |
| 6,656,253 | B2 | | 12/2003 | Willey et al. | |
| 2004/0089156 | A1 | | 5/2004 | Garstein et al. | |

FOREIGN PATENT DOCUMENTS

| | | | |
|---|---|---|---|
| JP | 53-5466 | * | 1/1978 |

* cited by examiner

*Primary Examiner*—Richard L. Chiesa
(74) *Attorney, Agent, or Firm*—Robert W. Harris

(57) ABSTRACT

Process and apparatus for gas cleaning, as in HVAC systems or semiconductor manufacturing clean rooms, for removing 99.999% of particulate and gaseous contaminants, which may be effectively used to remove and neutralize Bio-chem agents introduced by terrorists, having a first stage in which large quantities of positively charged liquid droplets are introduced into the gas to be cleaned so as to remove virtually all negatively charged particulates and at least 90% of neutral particulates and soluble gases; a second stage in which most positively charged droplets from the first stage are removed and remaining particulates are given a positive charge; a third stage in which large quantities of negatively charged liquid droplets are introduced to remove positively charged particulates and more soluble gas contaminants; and a fourth stage in which the negatively charged droplets are removed from the cleaned gas stream.

25 Claims, 2 Drawing Sheets

GAS SCRUBBING PROCESS AND APPARATUS

BACKGROUND OF THE INVENTION

The present invention pertains to processes and apparatus for scrubbing of air or other gases for removal of both particulate and gaseous contaminants, with a very high removal efficiency, so as to allow use of the invention for example in building HVAC systems for removal and neutralization of Bio-chem agents such as anthrax which terrorists may introduce into the air; and to remove very small particulates and gases from the air in clean rooms used in semiconductor manufacturing; and for cleaning of air in hospital clean rooms; and for cleaning of air or other gases in industrial processes, for effluent pollutant emission control and/or for removal of contaminants introduced in one stage of a process which may interfere with later process steps.

Many gas scrubbing processes and apparatus are known in the prior art, including but not limited to inventions using charged electrical droplets or otherwise using electrical forces in gas cleaning, as in processes and apparatus concerning or related to gas cleaning which are disclosed in applicant's U.S. Pat. Nos. 6,551,382B1; 6,156,098; 5,941,465; 5,147,423; 4,345,916; and 4,095,962. However, prior art inventions, though useful for many gas cleaning purposes, may not be adequate to deal with Bio-chem agents such as anthrax. And, they may not suffice to remove very small particulates, as small as 0.1 micron diameter, which may seriously interfere with semiconductor manufacturing in clean rooms, where deposit of such small particulates on a semiconductor surface may render the device inoperable.

The present invention is directed primarily to both the requirements of the semiconductor clean room manufacturing operation; and to the situation in which terrorists seek to kill large numbers of people by intentional contamination of air with deadly Bio-chem agents.

If bacterial spores such as anthrax, or viruses or deadly chemical agents such as nerve gas are introduced by terrorists into air which circulates in a building HVAC system, in order to render the air safe to breathe such deadly contaminants must be removed with a very high efficiency, of the order of 99.999%, by a suitable apparatus and process which cleans the air circulating in the HVAC system.

Although the charged droplet scrubber and method of applicant's U.S. Pat. No. 6,156,098 can remove most industry-generated air contaminants sufficiently to meet current regulatory standards for air pollution control, it would require large residence times of air exposure to scrubbing droplets, and large volume flow rates of the liquid scrubbing solution used in generation of the scrubber droplets to attain the desired contaminant removal efficiencies for semiconductor clean rooms and terrorist-contaminated air. Moreover applicant's '098 patent uses a very short range force acting between very highly charged droplet electric monopoles and electric dipoles induced in uncharged particulates, a force varying inversely as the fifth power of the droplet/particulate separation distance, '098 patent at Col. 6, line 35-Col. 7, line 4. In contrast the present invention uses the much longer range coulomb force between charged droplets and oppositely charged particulates, which varies inversely only as the square of the separation distance.

Accordingly the present invention is capable of achieving the desired removal efficiencies with much smaller residence time and much smaller volume of scrubbing liquid solution, and to very efficiently remove particulates in the 0.01 to 1 micron and greater size range.

In addition, for anti-terrorist applications including HVAC applications, some embodiments of the present invention are capable of not only capturing Bio-Chem agents, but also destroying them, by use of a dilute basic bleach solution as the scrubbing liquor. This offers an advantage over technology currently used to remove Bio-Chem agents, namely HEPA and activated carbon filters, which require maintenance and which can capture but not destroy the Bio-Chem agents.

It is not the intent of this application, by stating that certain embodiments of the present invention are suited to certain purposes or to dealing with certain problems, to necessarily limit the scope of the invention to only embodiments which are useful for said purposes or problems; it is instead the intent that the scope of the invention be determined by the claims as more fully stated below.

SUMMARY OF THE INVENTION

As a summary, this section of course does not explicate the invention in all the detail of the subsequent detailed description and claims. It is intended that the relative brevity of this summary shall not limit the scope of the invention, which scope is to be determined by the claims, properly construed, including all subject matter encompassed by the doctrine of equivalents as properly applied to the claims.

The invention is a process and apparatus for removing both particulate and gaseous contaminants from a gas to be cleaned, to a very high efficiency of the order of 99.999%, employing multiple stage cleaning steps, and is suitable for cleaning air streaming through HVAC systems which has been intentionally contaminated with Bio-Chem agents introduced by terrorists, and is also suitable for high efficiency cleaning of air in semiconductor manufacturing clean rooms. Some embodiments also include means for destroying Bio-Chem agents removed from the air being cleaned. Other possible applications include cleaning of air in hospital safe rooms, e.g. rooms for persons with serious allergic reactions or impaired immune systems; removal of industrial toxic effluents; and cleaning of air or other gases involved in industrial processes, where some substance must be removed from the air or other gas before the next process step.

In one broad aspect the invention is a process for cleaning contaminants from a gas stream of flowing gas, which said gas may be air, and which said contaminants may be particulate contaminants and may be gaseous contaminants, comprising the steps of: Intimately mixing said gas stream with a copious quantity of positively charged liquid droplets, hereafter "positive droplets", by injecting said positive droplets into said gas stream, and by providing said positive droplets with a combination of size, charge magnitude, positive droplet production rate and length of travel of said positive droplets in said gas, so as to cause said positive droplets to adsorb at least about 99% of said contaminants which are said particulates initially having negative charges, and at least about 90% of said particulates which are initially neutral, and to absorb at least about 90% of said contaminants which are said gaseous contaminants; Removing at least about 99% of said positive droplets having diameters greater than 50 microns from said gas stream, along with all of said contaminants which have been adsorbed and absorbed by said positive droplets; Positively charging at least about 99.9% of said particulate contaminants which were neutral at inception of said positively charging step;

Intimately mixing said gas stream with a copious quantity of negatively charged liquid droplets, hereafter "negative droplets", by injecting said negative droplets into said gas stream, and by providing said negative droplets with a combination of size, charge magnitude, negative droplet production rate and length of travel of said negative droplets in said gas, so as to cause said negative droplets to adsorb at least about 99.9% of said contaminants which are said particulates having positive charges; and Removing at least about 99.9% of said negative droplets from said gas stream, along with all of said contaminants which have been adsorbed and absorbed by said negative droplets.

In another broad aspect the invention is an apparatus for cleaning contaminants from a gas stream of flowing gas, said flowing gas having a flow direction defining a downstream direction, which said gas may be air, and which said contaminants may be particulate contaminants and may be gaseous contaminants, comprising: A first droplet injection means, immersed in said gas stream, for intimately mixing said gas stream with a copious quantity of positively charged liquid droplets, hereafter "positive droplets", by injecting said positive droplets into said gas stream, and by providing said positive droplets with a combination of size, charge magnitude, positive droplet production rate and length of travel of said positive droplets in said gas, so as to cause said positive droplets to adsorb at least about 99% of said contaminants which are said particulates initially having negative charges, and at least about 90% of said particulates which are initially neutral, and to absorb at least about 90% of said contaminants which are said gaseous contaminants; A first droplet removal means, immersed in said gas stream downstream from said first droplet injection means, at a location sufficiently downstream from said first droplet injection means to allow said positive droplets to have achieved the desired interaction with said contaminants before reaching said first droplet removal means, for removing at least about 99% of said positive droplets having diameters greater than 50 microns from said gas stream, along with all of said contaminants which have been adsorbed and absorbed by said positive droplets; A positive charging means, immersed in said gas stream downstream from said first droplet removal means, for positively charging at least about 99.9% of said particulate contaminants which were neutral just before reaching said positive charging means; A second droplet injection means, immersed in said gas stream downstream from said positive charging means, for intimately mixing said gas stream with a copious quantity of negatively charged liquid droplets, hereafter "negative droplets", by injecting said negative droplets into said gas stream, and by providing said negative droplets with a combination of size, charge magnitude, negative droplet production rate and length of travel of said negative droplets in said gas, so as to cause said negative droplets to adsorb at least about 99.9% of said contaminants which are said particulates having positive charges; and a second droplet removal means, immersed in said gas stream downstream from said second droplet injection means, at a location sufficiently downstream from said second droplet injection means to allow said negative droplets to have achieved the desired interaction with said contaminants which are said particulates having positive charges, before reaching said second droplet removal means, for removing at least about 99.9% of said negative droplets from said gas stream, along with all of said contaminants which have been adsorbed and absorbed by said negative droplets.

DETAILED DESCRIPTION

Those familiar with the art will understand that the invention may be employed in varied embodiments, for various specific purposes, without departing from the essential substance thereof. The description of any one embodiment given below is intended to illustrate an example rather than to limit the invention. This section is not intended to indicate that any one embodiment is necessarily preferred over any other one for all purposes, or to limit the scope of the invention by describing any such embodiment, which invention scope is intended to be determined by the claims, properly construed, including all subject matter encompassed by the doctrine of equivalents as properly applied to the claims.

Structural Considerations

Figure 1A:
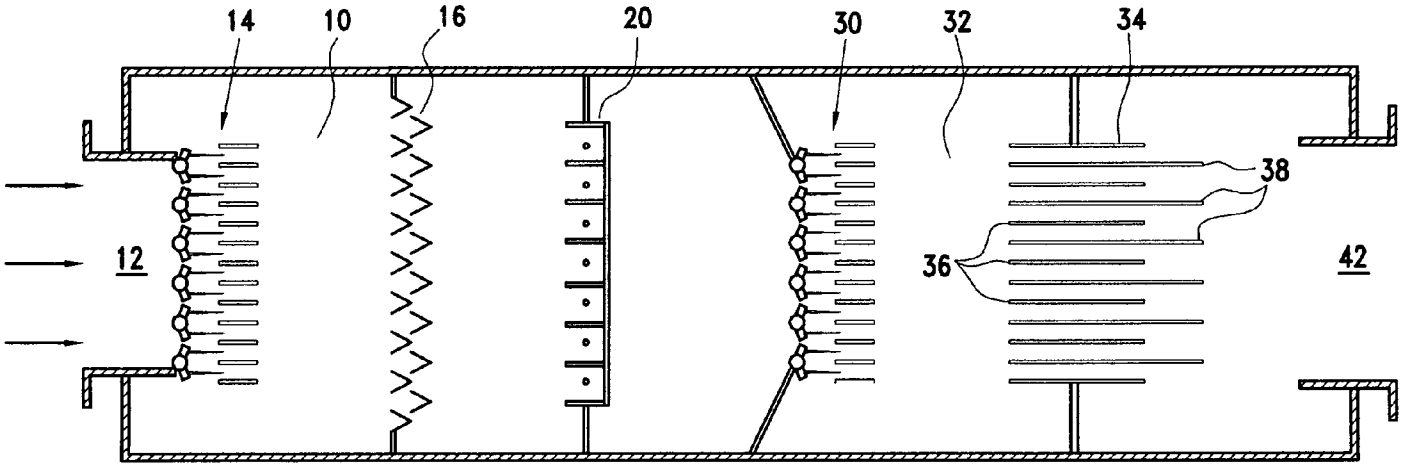
FIG. 1A is a plan view of the apparatus, for a horizontal embodiment of the invention.
Figure 1B:
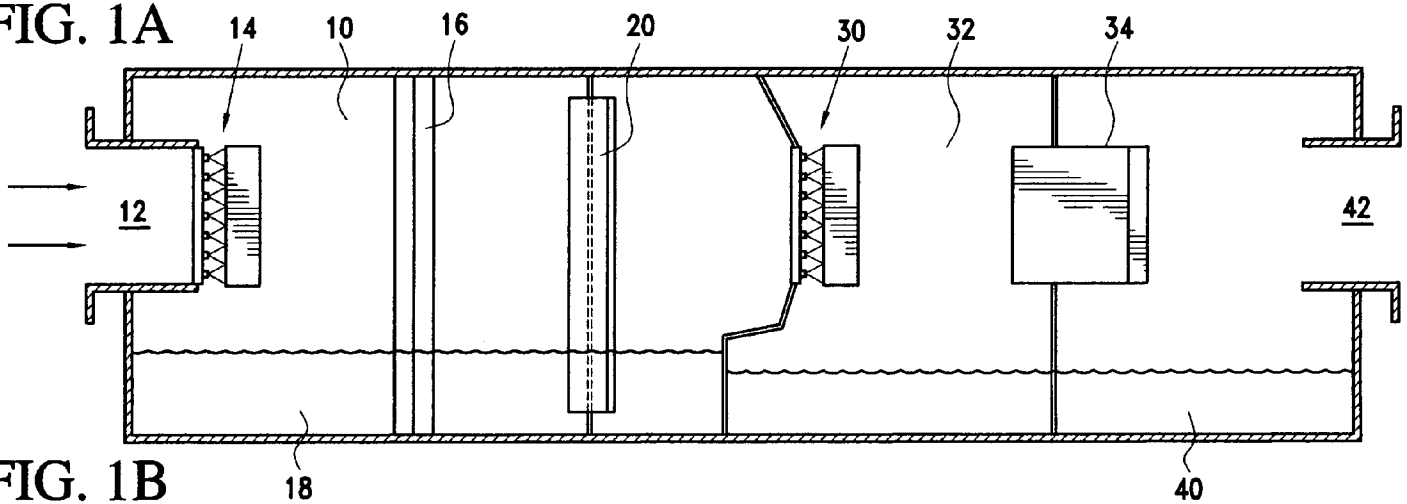
FIG. 1B is an elevational view of the same apparatus shown in FIG. 1A, for the same embodiment.

Referring now to the drawings, in which like reference numbers denote like or corresponding elements, a horizontal configuration of the invention apparatus is illustrated in FIGS. 1A and 1B. The gas to be cleaned enters a first chamber 10 through an inlet 12. The gas to be cleaned flows into first chamber 10 under the influence of an external fan or other gas moving mechanism (not shown), e.g. of a building HVAC system, which is not shown in the drawings because it is not part of the present invention; it is assumed that some flow generation instrumentality, external to the present invention, causes a flow of the gas to be cleaned, into, through and out of the apparatus of the invention.

In the first chamber 10, the gas to be cleaned passes through a Positively-Charged-Drop generator 14, where it is intimately mixed with copious quantities of positively charged liquid drops. The Positively-Charged-Drop generator 14 is a means to continuously produce a large quantity of positively charged liquid droplets, which may be but is not necessarily an apparatus for such purpose of the form disclosed in applicant's U.S. Pat. No. 6,156,098 or 5,941,465, in which spreading liquid sheets produce droplets emitted from the edges of the sheets into electric fields sufficient to charge the emitted droplets, the specifications and drawings of which patents are entirely incorporated herein by this reference.

The gas flows in first chamber 10 through a Drop Eliminator 16, about 10 feet downstream from Positively-Charged-Drop generator 14, a distance sufficient to allow adequate mixing of the positive droplets with the gas to be cleaned. In the Drop Eliminator 16, drops of liquid of diameter greater than about 50 microns are removed by impaction onto the surfaces of Drop Eliminator 16, and drain into a First Sump 18 at the bottom of first chamber 10, carrying with them the contaminant particulates and contaminant gases which the drops have collected through scrubbing of the gas to be cleaned in first chamber 10.

The contaminant-containing liquid in First Sump 18 may be passed through a screen (not shown) and recirculated to Positively-Charged-Drop generator 14 by a pump (not shown).

After passing through Drop Eliminator 16, the gas next passes through a Particle Charger 20, in which the particulates remaining in the gas are exposed to a uniform cross flow of positive ions, for the purpose of positively charging remaining particulates. Some positive ions strike and attach to particulates in Particle Charger 20; other particulates are positively charged downstream of Particle Charger 20, by positive ions from Particle Charger 20 which become entrained in the gas stream.

Figure 2B:
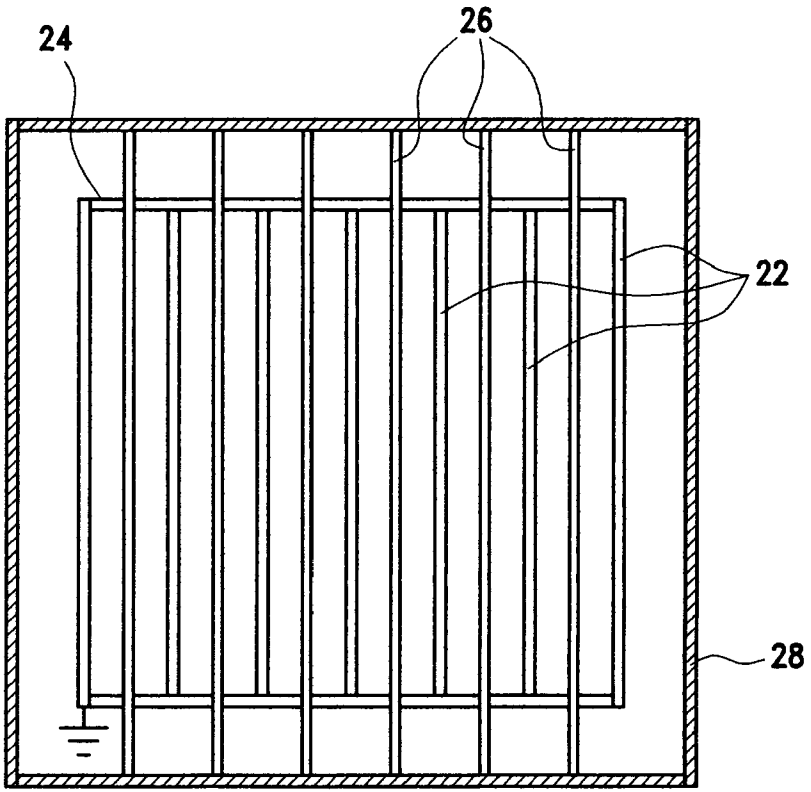
FIG. 2B is an elevational view of the particle charger shown in FIG. 2A, facing upstream (opposite the gas flow direction).
Figure 2A:
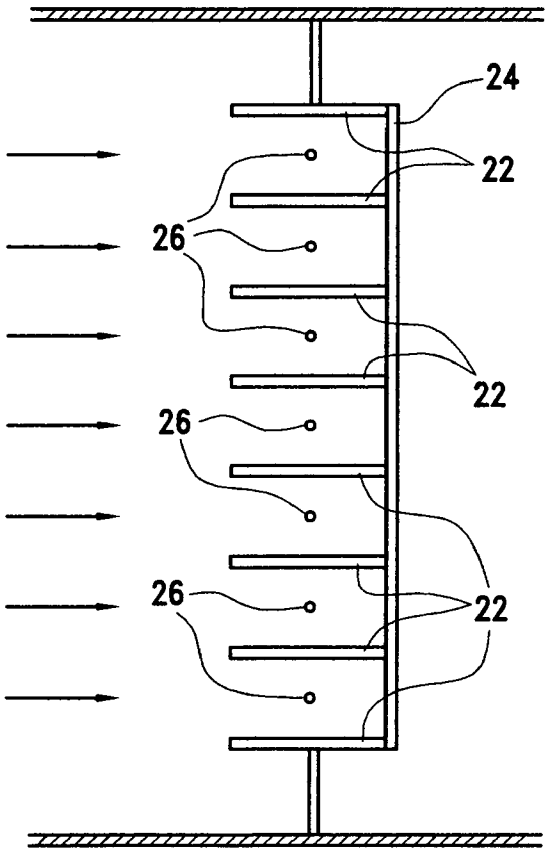
FIG. 2A is a plan view of the particle charger of the same embodiment.

One embodiment of Particle Charger 20 is shown in FIGS. 2A and 2B. The Particle Charger 20 consists of an array of parallel planar vertical Grounded Induction Electrodes 22, each having its width oriented parallel to the gas flow direction so that the gas may readily flow between said electrodes, with said electrodes being supported by a grounded frame 24; and an array of vertical Corona Discharge Wires 26, each spaced at least substantially equidistant between the closest two of the Grounded Induction Electrodes 22, with the Corona Discharge Wires 26 being attached to a High Voltage Frame 28, which is maintained at a high positive voltage by a power supply (not shown) through an electrical bushing (not shown).

In a particular embodiment the Grounded Induction Electrodes 22 have a spacing of about 4 inches, and each have cross sections of about 4 inches by 0.25 inches. The Corona Discharge Wires 26 have a diameter of 0.010 inches, are at least substantially centered between the Grounded Induction Electrodes 22, and are maintained at a voltage in the range from about 15 KV to about 30 KV. Applicant's tests indicate that tungsten is the best choice of material for Corona Discharge Wires 26; the Grounded Induction Electrodes 22 need to be noncorroding and highly conductive, and are best made of stainless steel or other corrosion-resistant alloys.

After passing through Particle Charger 20, the gas next encounters a Negatively-Charged-Drop Generator 30, where it is intimately mixed with copious amounts of negatively charged liquid drops. The distance between Particle Charger 20 and Negatively-Charged-Drop Generator 30 needs to be adequate to provide about 1 sec. residence time for the positive ions in the gas; about 6 to 8 feet is sufficient under optimum operating conditions.

The Negatively-Charged-Drop Generator 30 is a means to continuously produce a large quantity of negatively charged liquid droplets, which may be but is not necessarily an apparatus of the form of Positively-Charged-Drop generator 14 though operated to produce negative rather positive drop polarity, and may be an apparatus of the form disclosed in applicant's U.S. Pat. No. 6,156,098 or 5,941,465, in which spreading liquid sheets produce droplets emitted from the edges of the sheets into electric fields sufficient to charge the emitted droplets, the specifications and drawings of which patents are entirely incorporated herein by this reference.

After passing through Negatively-Charged-Drop Generator 30, the gas enters a Chamber 32, in which there is additional intimate mixing of negatively charged liquid drops and positively charged particulates, over a length of up to about 10 feet in Chamber 32, resulting in a high collection efficiency for particulate collection by the drops.

The gas then passes through an Electrostatic Mist Eliminator 34, which removes negatively charged drops and positive particulates collected by the drops, as the final gas cleaning step. In one embodiment the Electrostatic Mist Eliminator 34 consists of an array of parallel Grounded Plate Electrodes 36, and a set of parallel Positive High Voltage Plate Electrodes 38, interspersed and equally spaced between the Grounded Plate Electrodes 36. The Positive High Voltage Plate Electrodes 38 are longer than Grounded Plate Electrodes 36, to obtain suitable electric field configuration without arc over. The Positive High Voltage Plate Electrodes 38 are maintained at a positive voltage of 10 to 25 KV by a suitable high voltage and connections (not shown), so as to collect the negatively charged drops and collected contaminants from the gas flowing though Electrostatic Mist Eliminator 34. The collected liquid falls into Second Sump 40, from which it may be screened and recirculated to Negatively-Charged-Drop Generator 30 by screen and pump means (not shown).

The cleaned gas exits the apparatus by flowing out through Clean Gas Outlet 42.

Operational Considerations

Elements of the invention and its operation must be considered in light of the potential for both beneficial and possible adverse synergistic interactions among processes occurring in different stages of the apparatus and process, in order to achieve optimal gas cleaning results. As a result of such synergistic effects, the operation of the invention may not properly be viewed as a simple linear sum of effects produced by the processes occurring in the individual apparatus and process stages. In particular it is important to avoid adverse space charge effects which may prevent attainment of good results.

In addition to maintaining suitable settings for the various pumps and blowers, the operator must maintain a suitable voltage on the Corona Discharge Wires 26, in Particle Charger 20. Too high a voltage will cause excessive corona current to be emitted into the gas, and thus cause excessive positive charging of the particulates remaining in the gas, which excessively positively charged particulates will constitute a space charge which will completely overwhelm and fully neutralize the negative drops generated downstream by Negatively-Charged-Drop Generator 30, rendering them ineffective for further collection of positive particulates. Applicant's tests and calculations indicate that the operator should maintain a voltage, on Corona Discharge Wires 26, adequate to produce only 1 to 4 milliamperes of corona current per 1,000 CFM of gas flow.

Avoidance of an undesirable space charge effect is also one purpose of the removal, at Drop Eliminator 16, of most of the positively charged drops and adsorbed particulates, which reduces the number density of remaining particulates to a level, less than 1% of incoming particle density, based on applicant's tests, and reduces the maximum particulate size to about 1 micron diameter, based on applicant's tests. These reductions are both necessary to avoid a "space charge suppression of corona" which could otherwise occur downstream within Particle Charger 20. This phenomenon, known in electrostatic precipitators, would involve positive ions from the Corona Discharge Wires 26 attaching to particulates in sufficient positive ion numbers to create a positive space charge field sufficient to choke off the corona discharge.

Another intra-stage interaction, offering an advantage for the present invention, occurs because Drop Eliminator 16 is designed to remove, by inertial impaction, the larger positively charged liquid drops, while nonetheless allowing enough of the smaller positively charged liquid drops through to keep the Grounded Induction Electrodes 22 of Particle Charger 20 wetted and washed, so as to remove particulate matter which could otherwise collect on Grounded Induction Electrodes 22. However, if all or too many of the positively charged droplets were allowed to pass through Drop Eliminator 16, the Particle Charger 20 would cause additional positive charge to be placed on the positively charged droplets, so that downstream there would be neutralization of the negative droplets made at Negatively-Charged-Drop Generator 30.

The effect of the positive corona produced by the operation of Particle Charger 20 is to produce positive charges having charge magnitudes of less than 10 elementary charge units, on the remaining particulates which pass through Particle Charger 20, based on both tests and calculations, which is not only sufficient but necessary for proper operation of the collection of said particulates by the negative droplets produced downstream in the Negatively-Charged-Drop Generator 30.

Optimum Gas Scrubbing Results

Applicant has tested the invention with the structural and operational elements described above.

Applicant's calculations and test results indicate removal of contaminant particulates as small as 0.1 micron diameter, with an overall removal efficiency of 99.999% for contaminant particulates; and at least 97.6% removal efficiency for soluble contaminant gases—the removal of contaminant gases requires solubility of the contaminant gases in the cleaning solution.

Applicant's tests and calculations indicate that in optimum operation described above, indicate that the positive droplets introduced by Positively-Charged-Drop generator 14 adsorb at least about 99% of contaminants which are particulates initially having negative charges, and at least about 90% of said particulates which are initially neutral, and absorb at least about 90% of the contaminants which are gaseous; and that at least about 99% of the positive drops from Particle Charger 20, along with all of the particulate and gaseous contaminants which have been adsorbed and absorbed by the positive drops, are removed from the gas stream by Drop Eliminator 16; and that the operation of Particle Charger 20 imparts positive charges to at least about 99.9% of remaining particulate contaminants which were neutral when reaching Particle Charger 20; and that the negative drops introduced by Negatively-Charged-Drop Generator 30 adsorb at least about 99.9% of said contaminants which are particulates having positive charges; and the Electrostatic Mist Eliminator 34 then removes at least about 99.9% of the negative droplets from the gas stream, along with all contaminants which have been adsorbed and absorbed by the negative droplets.

Destruction of Bio-Chem Agents

Where Bio-Chem agents are removed from the gas to be cleaned, as in defense of an HVAC system attacked by terrorists, the operator should add sufficient amounts of bleach and a caustic or other bactericide to First Sump 18 to insure destruction of anthrax spores and viruses, and to insure the solubility of chemical agents. In such applications, the Second Sump 40 would normally be maintained with fresh water, with the evaporation which occurs in First Chamber 10 being made up from Second Sump 40.

Other Considerations in Non-Bio-Chem Cases

For some other applications involving removal of acid gases, the operator must maintain pH control in First Sump 18.

Some Possible Variations of Embodiments

For example, and not by way of limitation, although the embodiment of the invention apparatus described above is horizontal, it would of course be possible to employ a vertical embodiment, depending upon the space limitations and building configuration at the installation where the invention is to be used.

Though the above-described embodiment recirculates scrubbing liquid to Positively-Charged-Drop generator 14 and Negatively-Charged-Drop Generator 30, after collection of the drops and screening, it would be possible, depending upon particular applications and scrubbing liquid availability, to continually use fresh scrubbing liquid, without recirculation.

As to the particular charge polarities described above, it would be possible to employ an embodiment of the invention in which all droplet and particulate charge polarities are reversed from those of the embodiment described above.

I claim:

1. Process for cleaning contaminants from a gas stream of flowing gas, which said gas may be air, and which said contaminants may be particulates and may be gaseous contaminants, comprising the steps of:

(a) Intimately mixing said gas stream with a copious quantity of positively charged liquid droplets, hereafter "positive droplets", by injecting said positive droplets into said gas stream, and by providing said positive droplets with a combination of size, charge magnitude, positive droplet production rate and length of travel of said positive droplets in said gas, so as to cause said positive droplets to adsorb at least about 99% of said contaminants which are said particulates initially having negative charges, and at least about 90% of said particulates which are initially neutral, and to absorb at least about 90% of said contaminants which are said gaseous contaminants;

(b) Removing at least about 99% of said positive droplets having diameters greater than 50 microns from said gas stream, along with all of said contaminants which have been adsorbed and absorbed by said positive droplets;

(c) Positively charging at least about 99.9% of said particulates which were neutral at inception of said positive charging of said particulates;

(d) Intimately mixing said gas stream with a copious quantity of negatively charged liquid droplets, hereafter "negative droplets", by injecting said negative droplets into said gas stream, and by providing said negative droplets with a combination of size, charge magnitude, negative droplet production rate and length of travel of said negative droplets in said gas, so as to cause said negative droplets to adsorb at least about 99.9% of said contaminants which are said particulates having positive charges; and (e) Removing at least about 99.9% of said negative droplets from said gas stream, along with all of said contaminants which have been adsorbed and absorbed by said negative droplets.

2. Process of claim 1, wherein said step of positively charging said initially neutral particulates is a step of exposing said gas stream to a cross flow of positive ions, and of providing said ions in sufficient charge magnitude, ion production rate, and length of said gas exposed to said cross flow of said ions, to achieve said percentage charging of said particulates.

3. Process of claim 1, further comprising the steps of recirculating liquid obtained from said positive droplets and said negative droplets removed from said gas stream, for reuse of said liquid in further generation of positive droplets and negative droplets, and screening said liquid for removal of any said contaminants in said liquid before said reuse of said liquid.

4. Process of claim 3, wherein said contaminants contain biochemically active materials which may be anthrax spores and may be viruses, and wherein said positive droplets are formed of a liquid containing a disinfecting substance suitable for killing said biochemically active materials, of a nature not harmful to human beings who breathe said air after treatment by said process, and wherein said negative droplets are formed of water.

5. Process of claim 4, wherein said disinfecting substance is a bactericide.

6. Process of claim 4, wherein said disinfecting substance is a bleach and bactericide composition.

7. Process of claim 6, wherein said bactericide composition is a caustic composition.

8. Process for cleaning contaminants from a gas stream of flowing gas, which said gas may be air, and which said contaminants may be particulates and may be gaseous contaminants, comprising the steps of:

(a) Intimately mixing said gas stream with a copious quantity of negatively charged liquid droplets, hereafter "negative droplets", by injecting said negative droplets into said gas stream, and by providing said negative droplets with a combination of size, charge magnitude, negative droplet production rate and length of travel of said negative droplets in said gas, so as to cause said negative droplets to adsorb at least about 99% of said contaminants which are said particulates initially having positive charges, and at least about 90% of said particulates which are initially neutral, and to absorb at least about 90% of said contaminants which are said gaseous contaminants;

(b) Removing at least about 99% of said negative droplets having diameters greater than 50 microns from said gas stream, along with all of said contaminants which have been adsorbed and absorbed by said positive droplets;

(c) Negatively charging at least about 99.9% of said particulates which were neutral at inception of said negative charging of said particulates;

(d) Intimately mixing said gas stream with a copious quantity of positively charged liquid droplets, hereafter "positive droplets", by injecting said positive droplets into said gas stream, and by providing said positive droplets with a combination of size, charge magnitude, positive droplet production rate and length of travel of said positive droplets in said gas, so as to cause said positive droplets to adsorb at least about 99.9% of said contaminants which are said particulates having negative charges; and (e) Removing at least about 99.9% of said positive droplets from said gas stream, along with all of said contaminants which have been adsorbed and absorbed by said negative droplets.

9. Apparatus for cleaning contaminants from a gas stream of flowing gas, said flowing gas having a flow direction defining a downstream direction, which said gas may be air, and which said contaminants may be particulates and may be gaseous contaminants, comprising:

(a) A first droplet injection means, immersed in said gas stream, for intimately mixing said gas stream with a copious quantity of positively charged liquid droplets, hereafter "positive droplets", by injecting said positive droplets into said gas stream, and by providing said positive droplets with a combination of size, charge magnitude, positive droplet production rate and length of travel of said positive droplets in said gas, so as to cause said positive droplets to adsorb at least about 99% of said contaminants which are said particulates initially having negative charges, and at least about 90% of said particulates which are initially neutral, and to absorb at least about 90% of said contaminants which are said gaseous contaminants;

(b) A first droplet removal means, immersed in said gas stream downstream from said first droplet injection means, at a location sufficiently downstream from said first droplet injection means to allow said positive droplets to have achieved the desired interaction with said contaminants before reaching said first droplet removal means, for removing at least about 99% of said positive droplets having diameters greater than 50 microns from said gas stream, along with all of said contaminants which have been adsorbed and absorbed by said positive droplets;

(c) A positive charging means, immersed in said gas stream downstream from said first droplet removal means, for positively charging at least about 99.9% of said particulates which were neutral just before reaching said positive charging means;

(d) A second droplet injection means, immersed in said gas stream downstream from said positive charging means, for intimately mixing said gas stream with a copious quantity of negatively charged liquid droplets, hereafter "negative droplets", by injecting said negative droplets into said gas stream, and by providing said negative droplets with a combination of size, charge magnitude, negative droplet production rate and length of travel of said negative droplets in said gas, so as to cause said negative droplets to adsorb at least about 99.9% of said contaminants which are said particulates having positive charges; and (e) A second droplet removal means, immersed in said gas stream downstream from said second droplet injection means, at a location sufficiently downstream from said second droplet injection means to allow said negative droplets to have achieved the desired interaction with said contaminants which are said particulates having positive charges, before reaching said second droplet removal means, for removing at least about 99.9% of said negative droplets from said gas stream, along with all of said contaminants which have been adsorbed and absorbed by said negative droplets.

10. Apparatus of claim 9, wherein said positive charging means is a means for exposing said gas stream to a cross flow of positive ions, and by providing said ions in sufficient charge magnitude, ion production rate, and length of said gas exposed to said cross flow of said ions, to achieve said percentage charging of said particulates.

11. Apparatus of claim 9, further comprising means for recirculating liquid obtained from said positive droplets and said negative droplets removed from said gas stream, for reuse of said liquid in further generation of positive droplets and negative droplets, and means for screening said liquid for removal of any said contaminants in said liquid before said reuse of said liquid.

12. Apparatus of claim 11, wherein said contaminants contain biochemically active materials which may be anthrax spores and may be viruses, and wherein said positive droplets are formed of a liquid containing a disinfecting substance suitable for killing said biochemically active materials, of a nature not harmful to human beings who breathe said air after treatment by said apparatus, and wherein said negative droplets are formed of water.

13. Apparatus of claim 12, wherein said disinfecting substance is a bleach and bactericide composition.

14. Apparatus of claim 13, wherein said bactericide composition is a caustic composition.

15. Apparatus of claim 9, wherein each said droplet injection means comprise means to producing a plurality of spreading liquid sheets emitting droplets from the edges of said sheets into said gas stream, and means to produce electric fields at the edges of said sheets of sufficient strength and polarity to charge said droplets to a desired charge magnitude and polarity as said droplets are emitted into said gas.

16. Apparatus of claim 9, wherein said first droplet removal means is a means for impaction of said droplets onto a surface.

17. Apparatus of claim 9, wherein said positive charging means comprises an array of parallel planar grounded induction electrodes, interspersed with an array of corona discharge wires, each of said corona discharge wires being parallel to said grounded induction electrodes and spaced equidistant between the two closest of said grounded induction electrodes, and means to maintain said corona discharge wires at a high positive voltage.

18. Apparatus of claim 9, wherein said second droplet removal means is an electrostatic mist eliminator comprising an array of parallel grounded plate electrodes interspersed and equally spaced between a set of parallel positive high voltage plate electrodes, said array of grounded plate electrodes being parallel to said positive high voltage electrodes, and means to maintain said positive high voltage electrodes at a positive high voltage.

19. Apparatus for cleaning contaminants from a gas stream of flowing gas, said flowing gas having a flow direction defining a downstream direction, which said gas may be air, and which said contaminants may be particulates and may be gaseous contaminants, comprising:

(a) A first droplet injection means, immersed in said gas stream, for intimately mixing said gas stream with a copious quantity of negatively charged liquid droplets, hereafter "negative droplets", by injecting said negative droplets into said gas stream, and by providing said negative droplets with a combination of size, charge magnitude, negative droplet production rate and length of travel of said negative droplets in said gas, so as to cause said negative droplets to adsorb at least about 99% of said contaminants which are said particulates initially having positive charges, and at least about 90% of said particulates which are initially neutral, and to absorb at least about 90% of said contaminants which are said gaseous contaminants;

(b) A first droplet removal means, immersed in said gas stream downstream from said first droplet injection means, at a location sufficiently downstream from said first droplet injection means to allow said negative droplets to have achieved the desired interaction with said contaminants before reaching said first droplet removal means, for removing at least about 99% of said negative droplets having diameters greater than 50 microns from said gas stream, along with all of said contaminants which have been adsorbed and absorbed by said negative droplets;

(c) A negative charging means, immersed in said gas stream downstream from said first droplet removal means, for negatively charging at least about 99.9% of said particulates which were neutral just before reaching said negative charging means;

(d) A second droplet injection means, immersed in said gas stream downstream from said negative charging means, for intimately mixing said gas stream with a copious quantity of positively charged liquid droplets, hereafter "positive droplets", by injecting said positive droplets into said gas stream, and by providing said positive droplets with a combination of size, charge magnitude, positive droplet production rate and length of travel of said positive droplets in said gas, so as to cause said positive droplets to adsorb at least about 99.9% of said contaminants which are said particulates having negative charges; and (e) A second droplet removal means, immersed in said gas stream downstream from said second droplet injection means, at a location sufficiently downstream from said second droplet injection means to allow said positive droplets to have achieved the desired interaction with said contaminants which are said particulates having negative charges, before reaching said second droplet removal means, for removing at least about 99.9% of said positive droplets from said gas stream, along with all of said contaminants which have been adsorbed and absorbed by said negative droplets.

20. Process for cleaning contaminants from a gas stream of flowing gas, which said gas may be air, and which said contaminants may be particulates and may be gaseous contaminants, comprising:

(a) A step for mixing said gas stream with positively charged liquid droplets, hereafter "positive droplets", and for causing said positive droplets to adsorb at least about 99% of said contaminants which are said particulates initially having negative charges, and at least about 90% of said particulates which are initially neutral, and to absorb at least about 90% of said contaminants which are said gaseous contaminants;

(b) A step for removing at least about 99% of said positive droplets having diameters greater than 50 microns from said gas stream, along with all of said contaminants which have been adsorbed and absorbed by said positive droplets;

(c) A step for positively charging at least about 99.9% of said particulates which were neutral at inception of said positively charging step;

(d) A step for mixing said gas stream with a copious quantity of negatively charged liquid droplets, hereafter "negative droplets", and for causing said negative droplets to adsorb at least about 99.9% of said contaminants which are said particulates having positive charges; and (e) A step for removing at least about 99.9% of said negative droplets from said gas stream, along with all of said contaminants which have been adsorbed and absorbed by said negative droplets.

21. Process of claim 20, further comprising at least one step for preventing space charge effects, originating in one step of said process, from adversely affecting the carrying out of any step of said process.

22. Process for cleaning contaminants from a gas stream of flowing gas, which said gas may be air, and which said contaminants may be particulates and may be gaseous contaminants, comprising:

(a) A step for mixing said gas stream with negatively charged liquid droplets, hereafter "negative droplets", and for causing said negative droplets to adsorb at least about 99% of said contaminants which are said particulates initially having positive charges, and at least about 90% of said particulates which are initially neutral, and to absorb at least about 90% of said contaminants which are said gaseous contaminants;

(b) A step for removing at least about 99% of said negative droplets having diameters greater than 50 microns from said gas stream, along with all of said contaminants which have been adsorbed and absorbed by said positive droplets;

(c) A step for negatively charging at least about 99.9% of said particulates which were neutral at inception of said negatively charging step;

(d) A step for mixing said gas stream with a copious quantity of positively charged liquid droplets, hereafter "positive droplets", and for causing said positive droplets to adsorb at least about 99.9% of said contaminants which are said particulates having negative charges; and (e) A step for removing at least about 99.9% of said positive droplets from said gas stream, along with all of said contaminants which have been adsorbed and absorbed by said negative droplets.

23. Process of claim 22, further comprising at least one step for preventing space charge effects, originating in one step of said process, from adversely affecting the carrying out of any step of said process.

24. Process for cleaning contaminants from a gas stream of flowing gas, which said gas may be air, and which said contaminants may be particulates and may be gaseous contaminants, comprising:

(a) alternate steps for mixing said gas stream with charged liquid droplets of opposite charge polarities, and for removing said charged droplets from said gas stream after said mixing; and (b) at least one step for charging uncharged particulates in said gas stream to an induced particulate charge polarity, just prior to a step of mixing of said gas stream with charged liquid droplets of a charge polarity opposite to said induced particulate charge polarity.

25. Process of claim 24, further comprising at least one step for preventing space charge effects, originating in one step of said process, from adversely affecting the carrying out of any step of said process.

* * * * *